United States Patent [19]

Ash

[11] Patent Number: 4,663,784

[45] Date of Patent: May 12, 1987

[54] HAND GLOVE

[75] Inventor: Neal T. Ash, Monroeville, Pa.

[73] Assignee: Jacob Ash and Company, Inc., Pittsburgh, Pa.

[21] Appl. No.: 724,083

[22] Filed: Apr. 19, 1985

[51] Int. Cl.[4] ..... A41D 19/00

[52] U.S. Cl. ..... 21/63; 2/159; 2/166; 2/169

[58] Field of Search ..... 2/158, 159, 161 A, 161 R, 2/163, 166, 164

[56] References Cited

U.S. PATENT DOCUMENTS

| | | | |
|---|---|---|---|
| 595,925 | 12/1897 | Schrecker | 2/166 X |
| 1,149,139 | 8/1915 | Heagle | 2/159 |
| 2,242,318 | 5/1941 | Mosier | 2/159 |
| 2,700,770 | 2/1955 | Stanton | 2/163 X |
| 2,713,172 | 7/1955 | Haschel et al. | 2/169 |
| 3,175,226 | 3/1965 | Weinberg | 2/159 |
| 4,245,357 | 1/1981 | Connelly | 2/163 |

*Primary Examiner*—Werner H. Schroeder
*Assistant Examiner*—J. L. Olds
*Attorney, Agent, or Firm*—Thomas H. Murray; Clifford A. Poff

[57] ABSTRACT

A hand glove includes elastic glove material fashioned to fit the hand of the user. Two palm pieces comprised of generally non-elastic material are sewn along the peripheries of the liner pieces to the elastic material of the glove. The palm pieces are fashioned such that one piece, generally triangular, is attached to form closely spaced, side-by-side stretch lines with the first palm part so that the glove material can stretch and deform in a palm area independently of the palm parts.

4 Claims, 5 Drawing Figures

HAND GLOVE

BACKGROUND OF THE INVENTION

Figure 2:
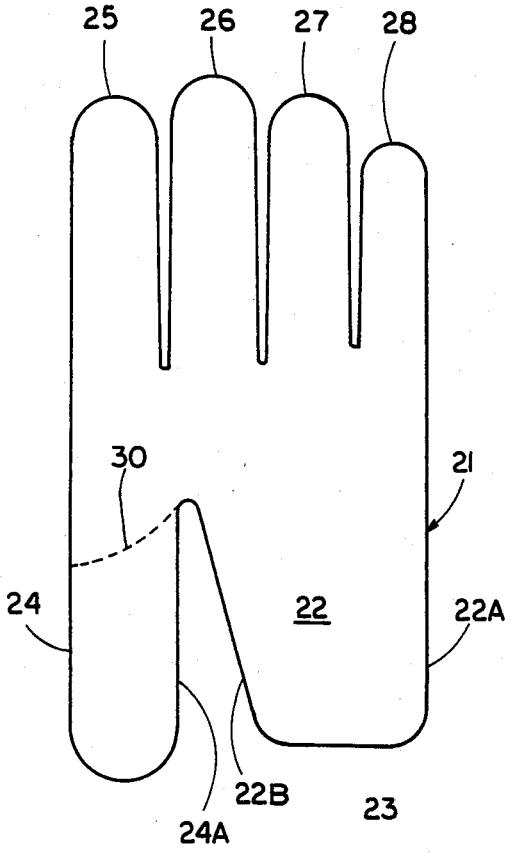

This invention relates to an approved construction for a glove of the type worn on a person's hand for protection particularly against the elements. More particularly the present invention provides a covering for the hand having a shell section comprised of stretchable material and to which there is applied a palm of generally non-stretchable material and fashioned in two sections which are sewn to the stretchable material along the peripheries thereof; the palm sections are arranged so that part of the stitching for each palm section extends along closely spaced and parallel lines in the palm section close to the crotch of a thumb pocket so that the palm parts can separate from one another during flexing movement of the hand in one or more directions across the palm section.

A glove which is defined to include a mitten is worn on the hand for protection against cold temperatures as well as an article of dress or for other reasons or purposes. Generally the glove forms a covering for the hand and includes a separate pocket for the thumb. An internal liner may or may not be used. A mitten, as is known, has one pocket for all of the fingers and a separate pocket for the thumb whereas a glove has separate pockets for each of the fingers and the thumb. The glove may be constructed so that part of the glove extends part way up the arm beyond the wrist. Gloves are commonly made from stretchable material such as spandex or knitted acrylic, bulky mohair, wool, Ragg wool, or cotton so that a glove will stretch to accommodate any one of various hand sizes. Frequently, however, it is desired to attach an exterior palm patch to the palm, finger and thumb sections not only to increase the esthetic property of the glove but also to provide better serviceability of the gloves. The palm patch also improves anti-slip properties. The glove shell may be knitted or formed in other manners to provide the desired elastic properties not only to accommodate a range of hand sizes but also flexing movement of the fingers. The exterior palm patch, which must be stitched to the glove shell, frequently tears away at the stitching. The palm patch material is generally made of a non-stretch fabric. The present invention is based on the surprising discovery that a palm patch comprised of two pieces is greatly superior to the conventional one-piece palm patch and the further discovery that by arranging palm patch pieces in a particular manner and affixing them to the palm portion of a glove shell utilizes the resiliency of the glove shell material for relieving stress at the attachment sites of the palm patches thereby to increase their longevity and comfort.

SUMMARY OF THE INVENTION

It is an object of the present invention to provide an improved arrangement of a two-piece palm attachment for the palm portion of a glove that will overcome the shortcomings of a single-piece palm attachment by effectively accommodating stretching and flexing of the glove shell particularly across the palm section thereof.

More particularly according to the present invention there is provided a hand glove having a thumb pocket joined to one lateral side of an elastic-palm section to which is applied a generally non-elastic palm comprised of two parts separately sewn to the elastic shell section along closely spaced, side-by-side lines extending from a wrist portion of the glove toward a line between the first and second fingers to a point beyond the thumb pocket for stretching of the glove material between closely spaced lines of stitching attaching the non-elastic palm parts to the elastic-shell section.

In the preferred form of the hand glove of the present invention, one of the two parts of the non-elastic palm comprises a triangularly shaped wedge extending from the wrist area to the palm across a crotch section of the thumb pocket and along part of the thumb pocket. Sections of the liner parts which extend along part of the thumb pocket are independently sewn along closely spaced, side-by-side seam lines which extend to the seam lines along the palm section for increased flexibility of the thumb pocket for both expansion of the elastic glove material and flexing movement of the material comprising the thumb pocket during lateral movement toward the palm section.

Figure 1:
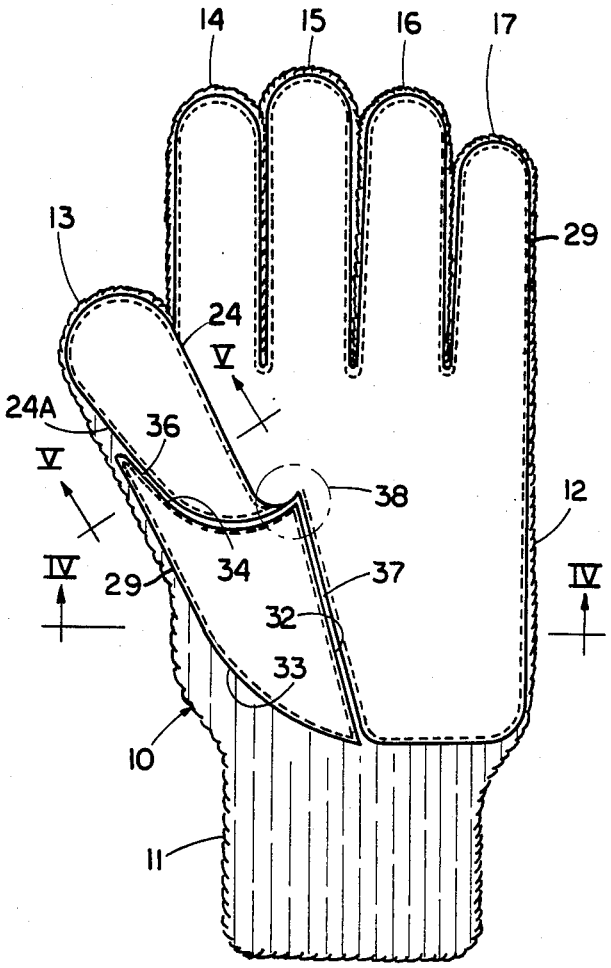
Figure 3:
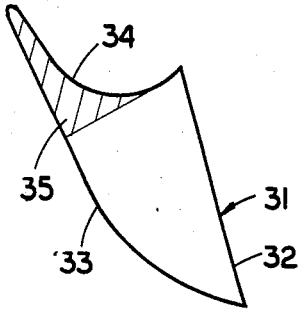
Figure 4:
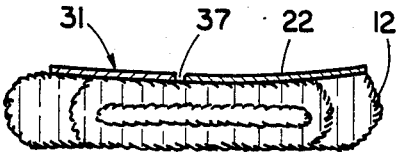
Figure 5:
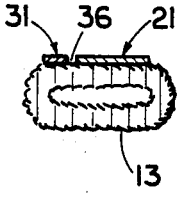

These features and advantages of the present invention as well as others will be more fully understood when the following description is read in light of the accompanying drawings in which:

FIG. 1 is a plan view of a glove embodying a two-piece palm affixed to the palm section thereof according to the present invention, FIG. 2 is a plan view of a first palm part as cut from a sheet of palm material, FIG. 3 is a plan view of a second palm part as cut from a sheet of palm material, FIG. 4 is a sectional view taken along lines IV—IV of FIG. 1, and FIG. 5 is a sectional view taken along lines V—V of FIG. 1.

In FIG. 1 there is illustrated a glove 10 including a wrist portion 11 extending to a palm section 12 having on one side thereof, depending on the hand of the user, a thumb pocket 13. At the side of the palm section 12 which is opposite the wrist section 11 there are, according to the embodiment of glove shown in FIG. 1, four finger pockets 14, 15, 16 and 17. When, for example, a glove takes the form of a mitten, finger pockets 14–17 will comprise a single pocket into which all the fingers of a person's hand are placed during use of the glove. The glove shell can be made from any suitable material having an elastic nature. Preferably the material is woven or knitted using acrylic, Ragg wool, cotton, or spandex thread. According to the present invention, a two-piece palm is cut from a sheet of material that is generally non-elastic, a suitable example of which is leather or vinyl is laminated on a backing material. The two-piece palm sections are so configured that both sections cooperate to form a palm on the palm section of the glove shell. As shown in FIGS. 2 and 3, a first palm section 21, (FIG. 2), is cut from a sheet of generally non-elastic material. Section 21 includes a palm portion 22 which terminates at wrist edge 23. Along one side of the palm portion 22 there is a thumb palm part 24. At the side of the liner which is opposite edge 23 there are four finger liner parts 25–28. The palm portion 22 has a width extending from an outside edge 22A to an inner palm dividing line 22B. The first palm section 21 is placed on the glove as shown in FIG. 1 in a generally overlying relation with the palm section as well as the finger and thumb pockets of the shell. A suitable glue is used to hold the palm section to the glove shell while its palm section is attached to the glove shell by stitches 29 that are closely spaced from the outer edge of the pattern and configuration of the palm about the entire periphery thereof.

To carry out this stitching operation, it is necessary to bend the thumb palm part at a base area which is located at the crotch of the thumb pocket back and upstands angularly from the palm section 12. The bend line is generally indicated by a line in FIG. 2 identified by reference numeral 30. The stitches 29 used to attach the first palm section to the glove is spaced about 1/16 to ⅛ of an inch inwardly from the outer peripheral edge of the liner. A second palm section, shown in FIG. 3 is identified by reference numeral 31 and is also stitched by stitches 29 to the glove shell in the same manner. The second palm section includes an edge portion 32 which is arranged to extend along the palm section of the glove in a closely spaced and side-by-side relation to edge 22B such that a small gap exists between these edges and, when sewn in place, the stitches 29 on palm sections 21 and 31 are further spaced so that a narrow strip of elastic-glove material forming a first stretch line between the palm sections. The first stretch line permits stretching and deformation of the glove material independently of the palms to accommodate to stretching forces applied laterally across the palm section during use of the glove. In this way, stresses tending to tear the palm parts from the glove material are reduced and the integrity of the stitching becomes long lasting.

As can be seen from FIG. 3, the second palm part section 31 has a generally triangular shape formed by the intersection of edge 32 with edges 33 and 34. The palm section, 31 also has a thumb palm portion denoted by broken lines and identified by reference numeral 35 which extends from the crotch of the thumb pocket at the palm section along the thumb pocket.

As can be best seen from FIGS. 4 and 5, thumb liner portion 35 wraps along part of the thumb pocket such that edge 34 is closely spaced and side-by-side with edge 24A (FIG. 2) of the first palm section to form a second site for stretching of glove material between the closely spaced lines of stitching which attach the lining to the glove. The second stretch line which is identified by reference numeral 36 extends to the first stretch line identified by reference numeral 37 and forms a site for stretching of the glove material in a longitudinal direction. The intersection of stretch lines 36 and 37 is generally at the thumb crotch which is a well known area at the base of the thumb generally falling within a circle identified by reference numeral 38. The second stretch line affectively accommodates stretching of the glove between the wrist portion and the finger pockets 14–17. Further, as will be appreciated by those skilled in the art, because of the discontinuous form of the palm pieces that are provided across the palm section to the base of the thumb section stretching of the shell effectively accommodates displacement of the thumb pocket in all planes of movement by the thumb. Thus, the invention utilizes the resiliency of the glove shell material to accommodate the movement of the thumb pocket. When a patch is added to the back of the shell, the two-piece palm of the present invention greatly reduces the likelihood that the non-stretch material will tear and attachment seams will fail. Movement of the thumb pocket toward and away from the finger pockets is adequately accommodated by the bend in the liner 21 along line 30.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A hand glove having a thumb pocket and at least a first finger pocket and a second finger pocket, said thumb pocket extending from a lateral side of an elastic palm section to which is applied a generally non-elastic palm piece comprised of two parts separately sewn to the elastic palm section from a glove wrist area toward a line between the first finger pocket and the second finger pocket to a point beyond the thumb pocket for stretching of the glove material between the closely spaced lines of stitching independently of the attached non-elastic palm parts whereby said two parts substantially cover the elastic palm section of the hand glove.

2. The hand glove according to claim 1 wherein one of the two parts of said non-elastic palm pieces comprises a generally triangular shaped wedge extending from the glove wrist area along the palm to a thumb crotch and along part of the thumb pocket.

3. The hand glove according to claim 1 wherein the two parts of the non-elastic palm pieces extend from the palm section to part of a thumb crotch and along part of said thumb pocket.

4. The hand glove according to claim 3 wherein the palm parts extending along part of said thumb pocket are independently sewn to the thumb pocket by closely spaced, side-by-side lines of stitching.

* * * * *